US007722123B2

(12) United States Patent
Holland

(10) Patent No.: US 7,722,123 B2
(45) Date of Patent: May 25, 2010

(54) FURNITURE HAVING REPLACEABLE PANELS

(75) Inventor: David Holland, Springfield, IL (US)

(73) Assignee: Sundry Design Solutions LLC, Springfield, IL (US)

( * ) Notice: Subject to any disclaimer, the term of this patent is extended or adjusted under 35 U.S.C. 154(b) by 177 days.

(21) Appl. No.: 11/427,383

(22) Filed: Jun. 29, 2006

(65) Prior Publication Data

US 2008/0001462 A1 Jan. 3, 2008

(51) Int. Cl.
*A47C 7/00* (2006.01)
*A47C 7/50* (2006.01)
*A47C 9/00* (2006.01)
*A47C 3/18* (2006.01)

(52) U.S. Cl. ..... 297/440.1; 297/423.1; 297/461

(58) Field of Classification Search ..... 297/440.15, 297/452.4, 232, 344.18, 411.24, 440.16, 297/188.06, 440.24, 440.14, 248, 184.16, 297/188.2, 462, 461, 440.1, 423.1; 108/156, 108/150; 40/606.08, 606.12, 611.01, 611.06
See application file for complete search history.

(56) References Cited

U.S. PATENT DOCUMENTS 1,488,889 A 4/1924 Lollis
1,639,085 A * 8/1927 Fohey ..... 297/188.04
1,935,682 A * 11/1933 Wege ..... 108/150
2,010,306 A * 8/1935 Leech ..... 248/412
2,611,416 A * 9/1952 Moore ..... 108/131
2,708,965 A * 5/1955 King ..... 297/461
2,711,786 A * 6/1955 Weiss ..... 297/452.14
2,730,419 A * 1/1956 Roberton et al. ..... 108/156
2,742,955 A * 4/1956 Dominguez ..... 108/41
3,023,050 A * 2/1962 Jensen ..... 297/462
3,181,913 A * 5/1965 Lewis et al. ..... 297/462
3,414,912 A * 12/1968 Dusey, Sr. et al. ..... 5/52
3,563,599 A * 2/1971 Heumann ..... 297/218.5
3,589,661 A * 6/1971 Harris ..... 248/432
3,663,058 A * 5/1972 Hirsch ..... 297/423.41
3,697,363 A 10/1972 Martinez
3,724,745 A * 4/1973 Brown ..... 232/43.2
3,797,695 A * 3/1974 Law ..... 297/188.1
3,896,743 A * 7/1975 Pariente ..... 108/190
4,158,277 A 6/1979 Krempp et al.
4,208,072 A * 6/1980 Iskendarian ..... 297/440.1
D258,853 S * 4/1981 Zola ..... D6/379
4,379,587 A * 4/1983 Duncan ..... 297/188.09
4,608,773 A * 9/1986 White ..... 40/606.01
4,760,802 A * 8/1988 Leong ..... 108/157.16
4,929,021 A 5/1990 Kaye (Continued)

FOREIGN PATENT DOCUMENTS

CH 602055 A5 * 7/1978

(Continued)

OTHER PUBLICATIONS

Johnston Casuals' model 9628 stool and model 9658 table .

*Primary Examiner*—David Dunn
*Assistant Examiner*—Tania Abraham
(74) *Attorney, Agent, or Firm*—Design IP

(57) ABSTRACT

A furniture item, such as a stool, table or chair having removable decorative panels. The removable panels include a surface that is preferably convex in shape when installed and provides an area upon which advertising, promotional and/or purely aesthetic material can be displayed.

17 Claims, 10 Drawing Sheets

U.S. PATENT DOCUMENTS 5,171,060 A * 12/1992 Kaye ..... 297/188.09
5,329,716 A * 7/1994 Fite ..... 40/575
5,353,716 A * 10/1994 Wilbert ..... 108/150
5,448,844 A 9/1995 Miller, Jr. et al.
5,471,794 A 12/1995 Nishioka
5,600,911 A 2/1997 Lucci
6,053,585 A 4/2000 Osen
6,123,031 A 9/2000 Hayman-Chaffey
6,269,570 B1 8/2001 Miles
6,543,071 B1 4/2003 Lenner
6,644,750 B1 * 11/2003 Sandman et al. ..... 297/440.21
6,658,677 B2 12/2003 Paul
6,749,265 B1 * 6/2004 Wang ..... 297/440.1
6,763,626 B1 7/2004 Wieringa
6,779,287 B2 8/2004 Venegas, Jr.
2003/0107247 A1 6/2003 Wills et al.
2003/0145377 A1 8/2003 Paul
2004/0048040 A1 3/2004 Nykamp et al.
2004/0154093 A1 * 8/2004 Akhtar ..... 4/526
2005/0080674 A1 4/2005 Howard
2005/0193606 A1 9/2005 Stangl et al.

FOREIGN PATENT DOCUMENTS

DE 202005003247 UU1 * 6/2005

* cited by examiner

FURNITURE HAVING REPLACEABLE PANELS

BACKGROUND OF THE INVENTION

The present invention is in the field of furniture. More specifically, the invention relates to furniture and legs for furniture having removable panels.

There is a growing trend in the marketplace toward "themed" restaurants, business retreat centers and other commercial establishments. In such establishments, companies often will pay to have their company name, products and/or services displayed. In an attempt to stay competitive, many commercial establishments are changing their decor more frequently. Accordingly, there is a need in the art for furniture that can be easily adapted to display advertising material, promotional material or purely aesthetic designs thereon, and enable new material to be displayed when an advertiser updates its materials, decor, or due to advertiser turnover.

SUMMARY OF THE INVENTION

The invention comprises the concept of providing removable panels on any one of a variety of furniture items, including stools, chairs or tables. The removable panels include a surface that is preferably convex in shape when installed and provides an area upon which advertising, promotional and/or decorative material can be displayed.

In one respect, the invention comprises a furniture item having a seat and a frame that supports the seat and extends from the seat to a surface upon which the stool rests. At least one panel, located between the seat and the surface, is also provided. The panel is removably attached to the frame and the frame is configured to enable installation and removal of the panel.

In another respect, the invention comprises a leg for a furniture item, the leg including a leg frame having a plurality of panel-retaining members that removably retain a panel and support members that attach the leg to the furniture item.

In yet another respect, the invention comprises a furniture item including an upper portion comprising a seat or a tabletop, a frame located below the upper portion. The frame provides vertical support for the upper portion. The furniture item also includes at least one panel that is removably installable on the frame and has a front surface that is externally visible when the at least one panel is installed on the frame.

BRIEF DESCRIPTION OF THE DRAWINGS

The present invention will hereinafter be described in conjunction with the appended drawing figures wherein like numerals denote like elements.

DETAILED DESCRIPTION OF THE PREFERRED EMBODIMENTS

Figure 1:
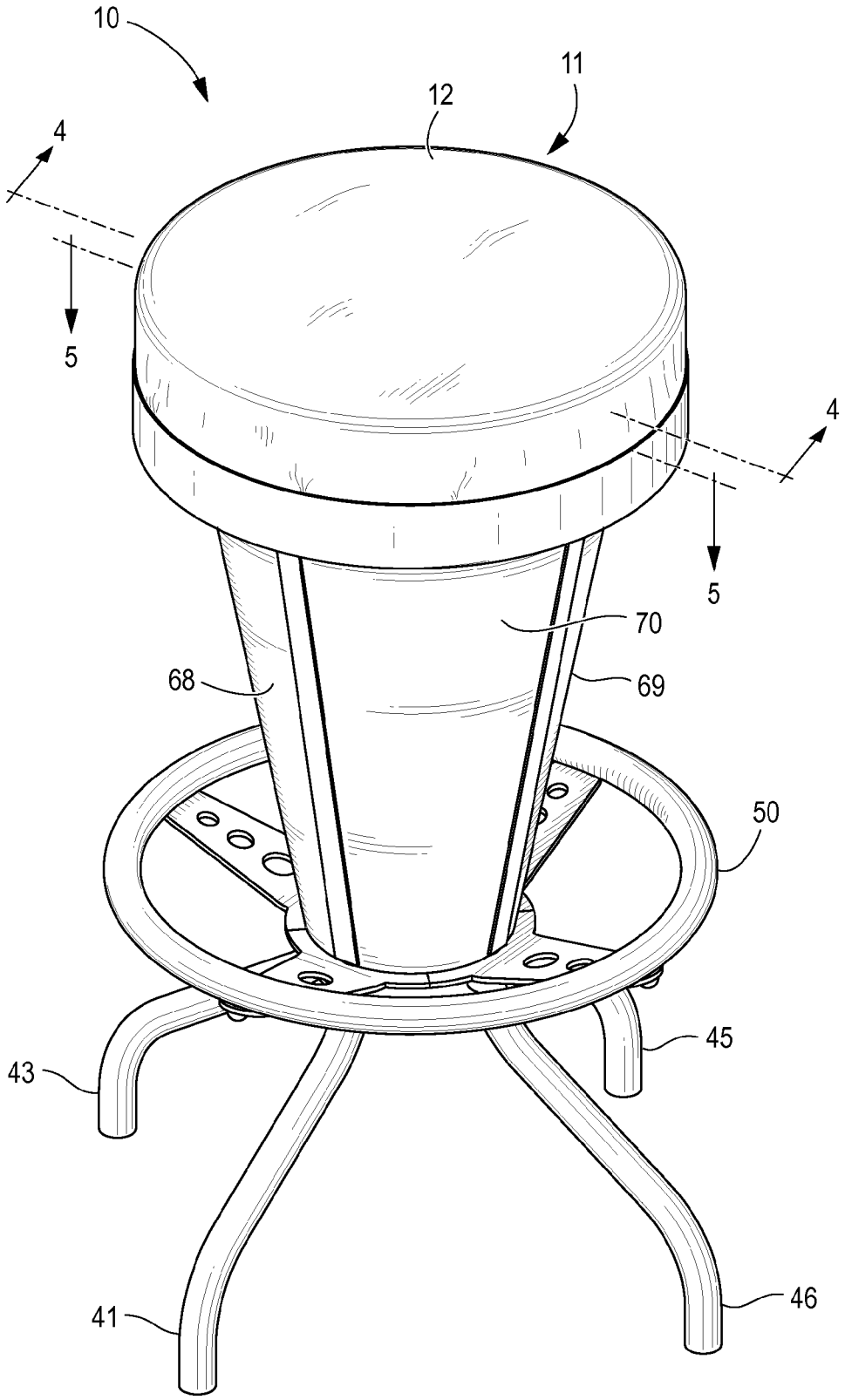
FIG. 1 is perspective view of a stool having non-rotating panels.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

To aid in describing the invention, directional terms are used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

FIG. 1 shows a first preferred embodiment of this invention in stool form 10 with major components including the seat 11, legs 41,43,45,46, foot rail 50 and four panels 68,69,70. The fourth panel is not visible in FIG. 1, and therefore, is not provided with a reference numeral. In the specification, "panels 68,69,70" is intended to refer to all four panels. The functions of these and other components will be explained in the ensuing paragraphs.

Figure 4:
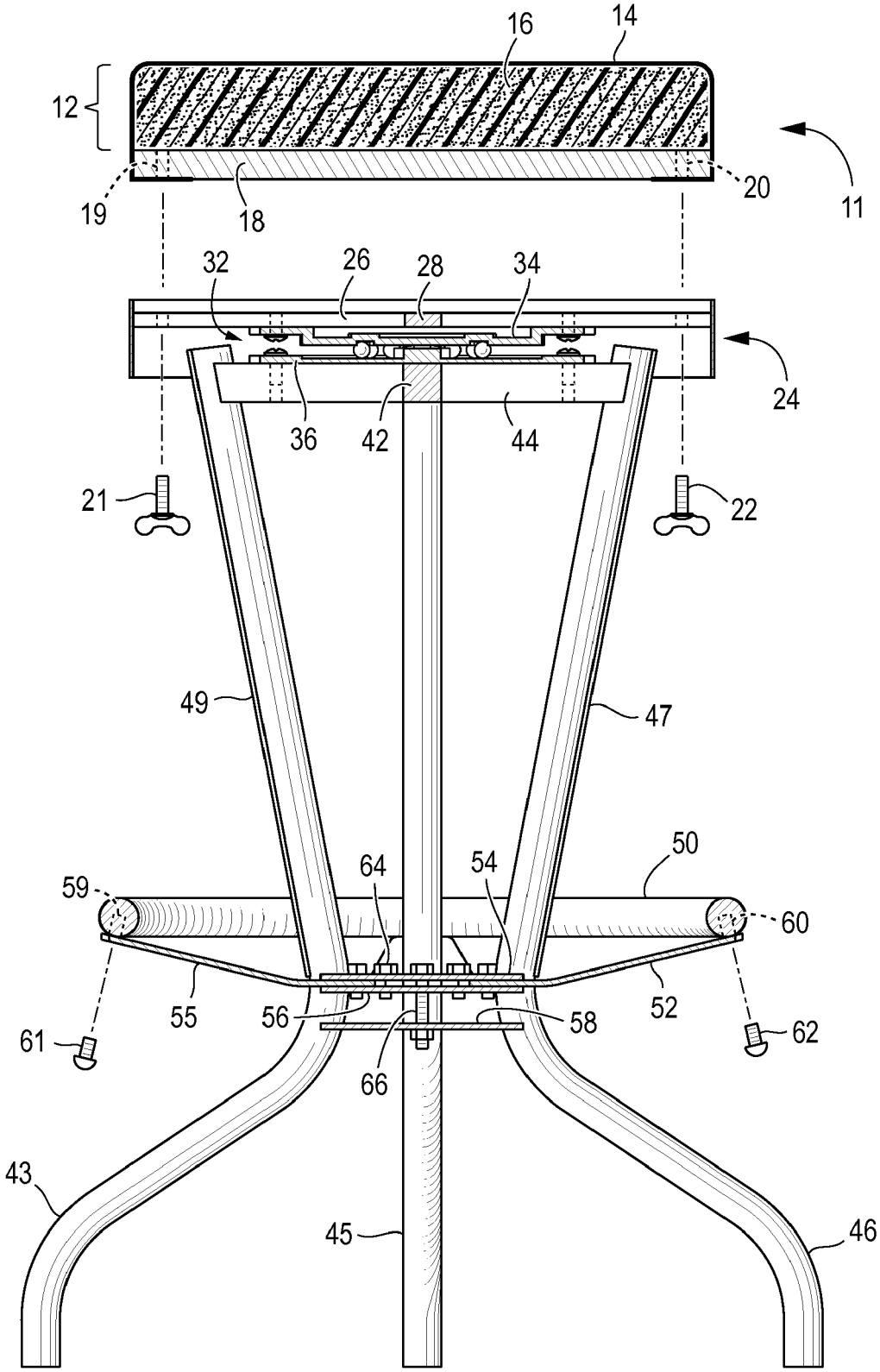
FIG. 4 is a side sectional view of the stool of FIG. 1.

Referring to FIG. 4, the seat 11 preferably includes a cushion 12 and a base 18. The cushion 12 preferably comprises a seat cushion cover 14 which may be made of any suitable material, such as cloth, vinyl or leather. The cover 14 is preferably provided with a foam core 16. An alternate construction could be a self skinning foam version in which the seat cushion cover 14 would be an integral component of the seat cushion 12. The seat cushion 12 also includes a seat base 18 to provide structural and attaching provisions. The seat base 18 provides a means to attach the seat cushion 12 to the seat support 24 utilizing threaded inserts 19,20. Two inserts are shown in FIG. 4, but a total of at least three and preferably four inserts are provided, in positions to correspond to the holes 23,25,27,29 in seat support bars 26,28 (see FIGS. 2 & 5).

The seat base 18 is preferably made from dense, structurally significant materials such as plywood, high-density particle board or oriented strand board. Alternatively, the seat base 18 could be molded from elastomers appropriate to provide the rigidity and support necessary for the user of seat cushion 12. Threaded inserts 19,20 (and others not shown) are preferably semi-permanently attached to the seat base 18 and provide the means for insertion of seat attaching fasteners 21,22 and others as applicable. The ultimate number of inserts 19,20 and fasteners 21,22 would depend on size of the seat and design retention requirements. The attaching fasteners 21,22 and others as applicable in this embodiment would preferably be thumb screws or other quick release style hardware to provide removable insert panel 68,69,70 functionality which will be detailed in subsequent paragraphs. The seat attaching fasteners 21,22 and those not shown pass through holes 23,25,27,29 in the seat support bars 26,28 and rigidly attach the seat cushion 12 to the seat support 24.

Figure 2:
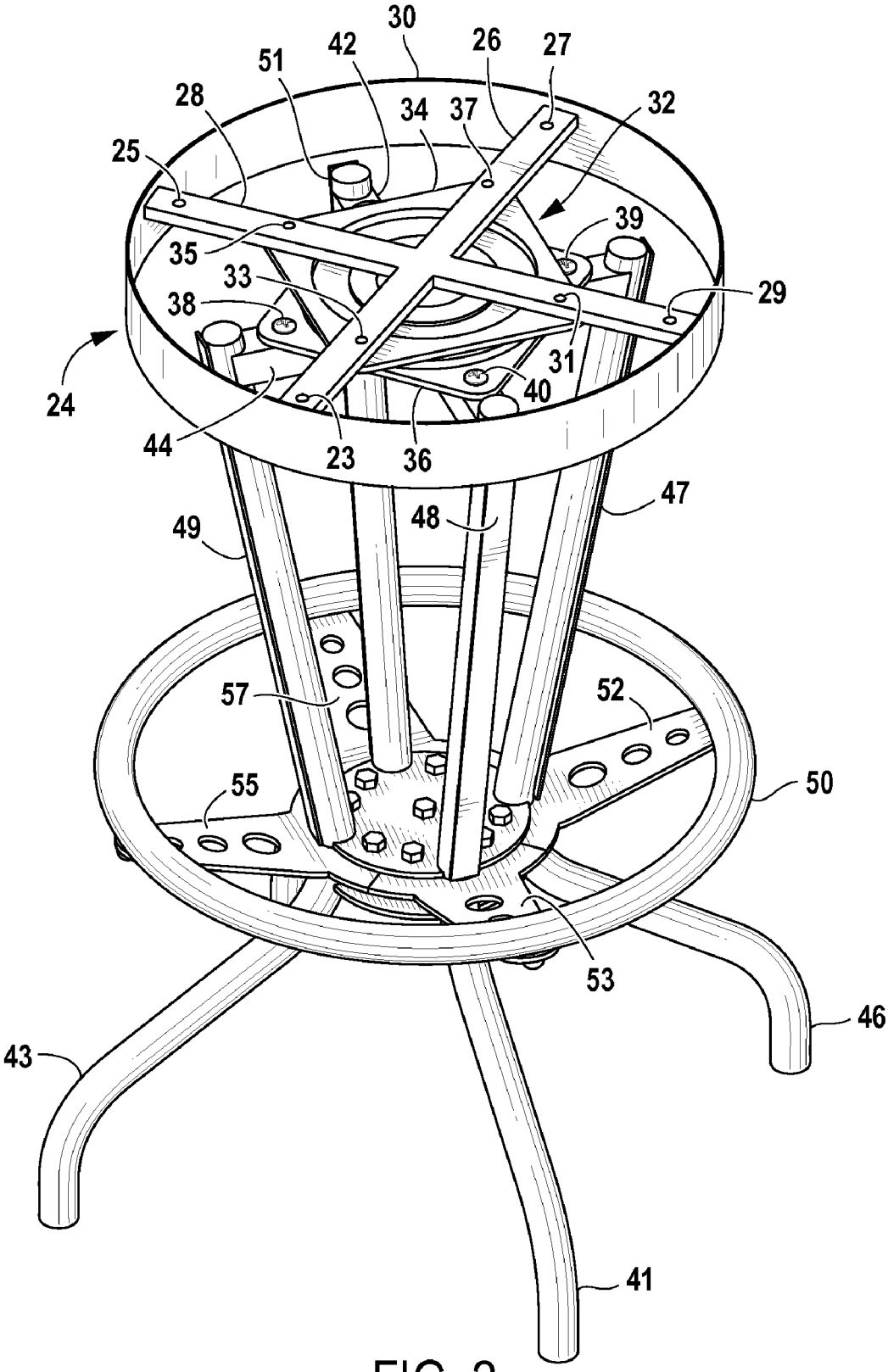
FIG. 2 is a perspective view of the stool shown in FIG. 1, in which the seat has been removed, in order to enable a clearer view of the stool substructure.

FIG. 2 shows the stool 10 with the seat cushion 12 removed so that the details of the sub-structure of the stool 10 are visible. The seat support 24 consists of seat support bars 26,28 and seat support ring 30. These seat support components would typically be fabricated of mild steel bar and strip materials and welded. The bars 26,28 have a number of drilled and/or tapped holes or inserts which provide attaching functionality for the seat cushion 12 and swivel 32. Swivel bottom plate fasteners 38,39,40 shown (and a fourth fastener, not shown) attach the swivel bottom plate 36 to a leg cross member 42 or 44. The leg cross member could have tapped holes, weld nuts or threaded inserts to accept the bottom plate fasteners 38,39,40. The fasteners between the swivel top plate 34 and seat support bars 26 or 28 are not shown. One version would include corresponding tapped holes or threaded inserts 31,33,35,37, enabling the use fasteners 38,39,40. Swivel 32 enables rotation of the seat support 24 relative to the rest of the stool 10.

FIG. 2 also shows the basic structure of the stool including the leg top cross members 42 & 44. The cross members 42,44 are preferably fabricated from a strong, rigid material, such as mild steel tubing. The cross-members 42,44 could be multi-piece, but also could be a single piece with a symmetrical center notch. The cross member 42 is preferably welded to legs 41,45 near the upper end of each leg. Similarly, cross member 44 is preferably welded to legs 43,46 near the upper end of each leg.

Continuing to refer to FIG. 2, legs 41,43,45,46 are the main structural members for the stool 10 and provide a mounting surface the panels 68,69,70, and in conjunction with the cross members 42,44, provide a mounting surface for the swivel 32. The legs 41,43,45,46 are preferably made from mild steel tubing that is bent into the desired shape shown in the FIGS. 2 & 4. The legs 41,43,45,46 engage the floor (or whatever surface the stool is placed on). Attached to each leg 41,43,45,46 is a panel retainer 47,48,49,51 whose function will be described with FIG. 5.

FIGS. 1,2 & 4 show foot rail 50, which is a member circular in cross section typically formed in a circle of a diameter large enough to provide a normal resting place for the feet of a user of the stool 10. The foot rail 50 and spokes 52,53,55,57 form the lower structure of stool 10 and with the upper, mid and lower plates 54,56 & 58 and related fasteners 61,62,64 and 66 provide the means of assembly and retention of the legs 41,43,45,46. A multiplicity of fasteners 64 would be used to retain spokes 52,53,55,57 in assembly with top and mid plates 54,56. The combination of top, mid and bottom plates 54,56,58 and the corresponding hardware 64,66 provides support and positioning of the foot rail 50 and legs 41,43,45,46. The foot rail 50, legs 41,43,45,46, cross members 42,44 and panel retainers 47,48,49,51 form a frame which provides vertical support for the seat 11.

Referring to FIG. 4, threaded inserts 59,60 in foot rail 50 allow insertion of fasteners 61,62 to form a rigid assembly. The spokes 52,53,55,57 are assembled between upper plate 54 and mid plate 56 using fasteners 64. In this embodiment, the fastener 64 is shown as a socket head screw. The mid plate 56 is shown having threaded inserts to accept the fastener 64, but could, alternatively, be attached with nuts (loose or welded to the bottom of the mid plate 56) or be drilled and tapped to accept the fastener 64.

Again referring to FIG. 4, the final structural components of the current embodiment are the lower plate 58 and lower plate fastener 66. Fastener 66 passes through and attaches the upper plate 54 to the lower plate 58 maintaining the position and rigidity of the legs 41,43,45,46, spokes 52,53,55,57 and foot rail 50. In this embodiment, fastener 66 is preferably a bolt or screw secured with a nut. Alternatively, any suitable fastener could be used.

Figure 3:
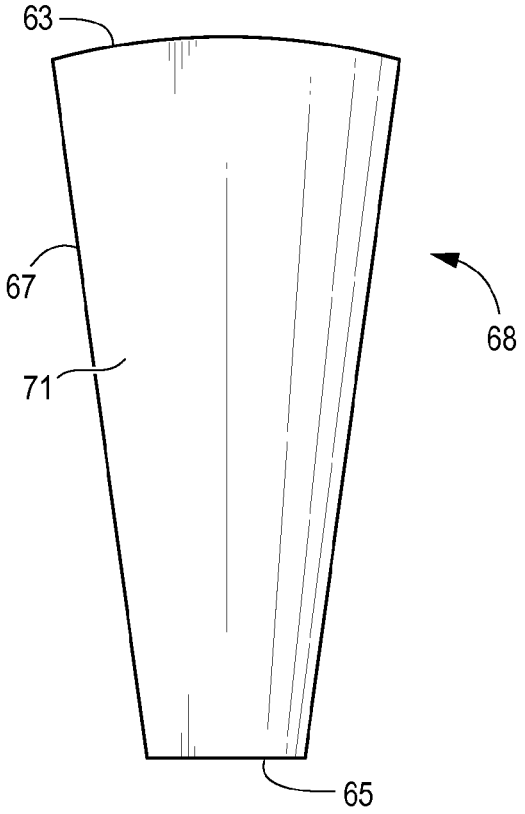
FIG. 3 is a front view of one of the removable panels used with the stool.

FIG. 3 shows a removable panel 68, which is preferably identical to the other three panels 69,70. The panels 68,69,70 are preferably fabricated from a ductile or resilient material capable of being deformed and returning to its original shape. The material used will vary, depending upon the desired appearance, and could include polycarbonate, phenolic-backed veneer, or metal, for example. The panels 68,69,70 may be constructed from flat stock materials as it requires no complex surface shape or edge profile and may function as originally flat or formed. Each panel 68 includes a linear (not shown) or convex upper edge 63, linear side edges 67 which taper from top to bottom, a linear bottom edge 65 and a front surface 71.

The front surface 71 of each panel 68 is preferably manufactured to be planar when under no external loading and is preferably convex (see FIG. 5) when installed on the frame. As can be seen in FIG. 1, in this embodiment the front surfaces of the panels 68,69,70 are externally visible and collectively define a display surface that is conical in overall shape and is preferably tapered from top to bottom. Although other shapes are possible, such as a cylindrical shape (see FIG. 8), the conical shape of the display surface of stool 10 is particularly desirable because it creates that appearance of a tapered beer glass, particularly when illuminated from within.

The display surface provides an area upon which advertising, promotional and/or decorative material can be displayed. Optionally, the panels 68,69,70 can be formed of a translucent material and illuminated from within using any suitable light source (light source not shown), such as an incandescent or fluorescent bulb.

The removability of the panels 68,69,70 allows for several beneficial functions. Advertising and promotional materials can be displayed on the panels 68,69,70 and can be easily changed to accommodate new advertisers and/or updates to the advertising materials. Several different panel appearances can be provided, such as different colors, materials and textures, which allow the stool 10 to be customized to match different decors. In addition, the panels 68,69,70 can be replaced in order to match a new decor or if one of the panels 68,69,70 is damaged or becomes worn.

Figure 5:
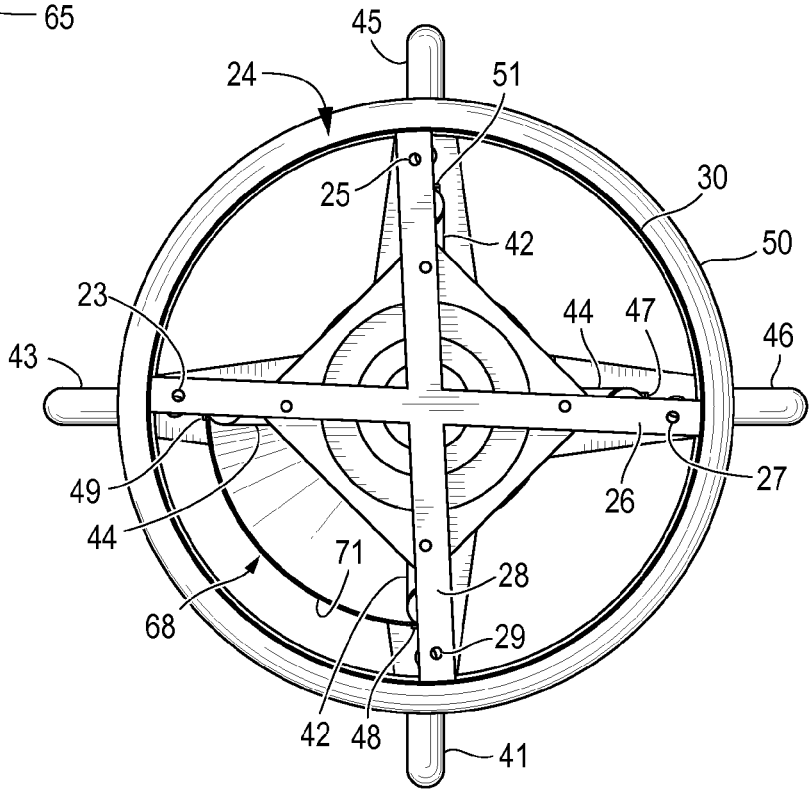
FIG. 5 is a top sectional view of the stool of FIG. 1.

FIG. 5 shows the top of the current embodiment with the seat cushion 12 removed to illustrate the specific details of this embodiment that enable easy removability of the insert panel 68. It should be noted that leg top cross members 42 & 44 are fabricated orthogonally, that is the included angle between the members is 90 degrees. However the included angles between the seat support bars 26,28 are alternately 85 & 95 degrees. With the quick release seat attaching fasteners 21,22 shown in FIG. 4 (and others not shown) allowing the seat cushion 12 to be quickly and easily removed, it can be seen that the non-orthogonal angle between the seat support bars 26,28 enable easy removal and replacement of the deformable insert panel 68 when the seat support 24 is rotated to the position shown over a leg top cross member 42 or 44. It can be seen also that the insert panels 69,70 not shown in FIG. 5 could be equally easily removed, also after removal of the seat cushion 12, by rotating the seat support 24 such that a 95 degree sector between the seat support bars 26,28 is moved over the subsequent panels.

Any time the seat cushion 12 is removed and a 95 degree sector of the seat support 24 is positioned over an insert panel 68,69,70, a panel may be easily removed by sliding the panel 68,69,70 upward between the seat support bars 26,28 until the panel 68,69,70 is free of the panel retainers 47,48,49,51. Alternatively, the panels 68,69,70 can be removed from the retainers 47,48,49,51 by flexing the side edges 67 of the panel 68 toward each other, which will release the side edges 67 from the retainers 49,51.

The panel retainers 47,48,49 are preferably made of linear, rigid strips of material such as mild steel, aluminum or elastomer and attached to the corresponding legs 41,43,45,46 either mechanically with fasteners not shown or welded. The insert panels 68,69,70 are retained between the legs 41,43,45,46 and the retainers 47,48,49,51 because of their tapered profile and the pocket created between any leg 41,43,45,46 and the corresponding retainer 47,48,49,51.

In this embodiment the insert panels 68,69,70 are flexible so that they will easily conform to the shape demanded by the configuration of the legs 41,43,45,46. This typically would also result in a light-weight part, which contributes to the ease of replacement of an individual or multiple panels 68,69,70.

Figure 6:
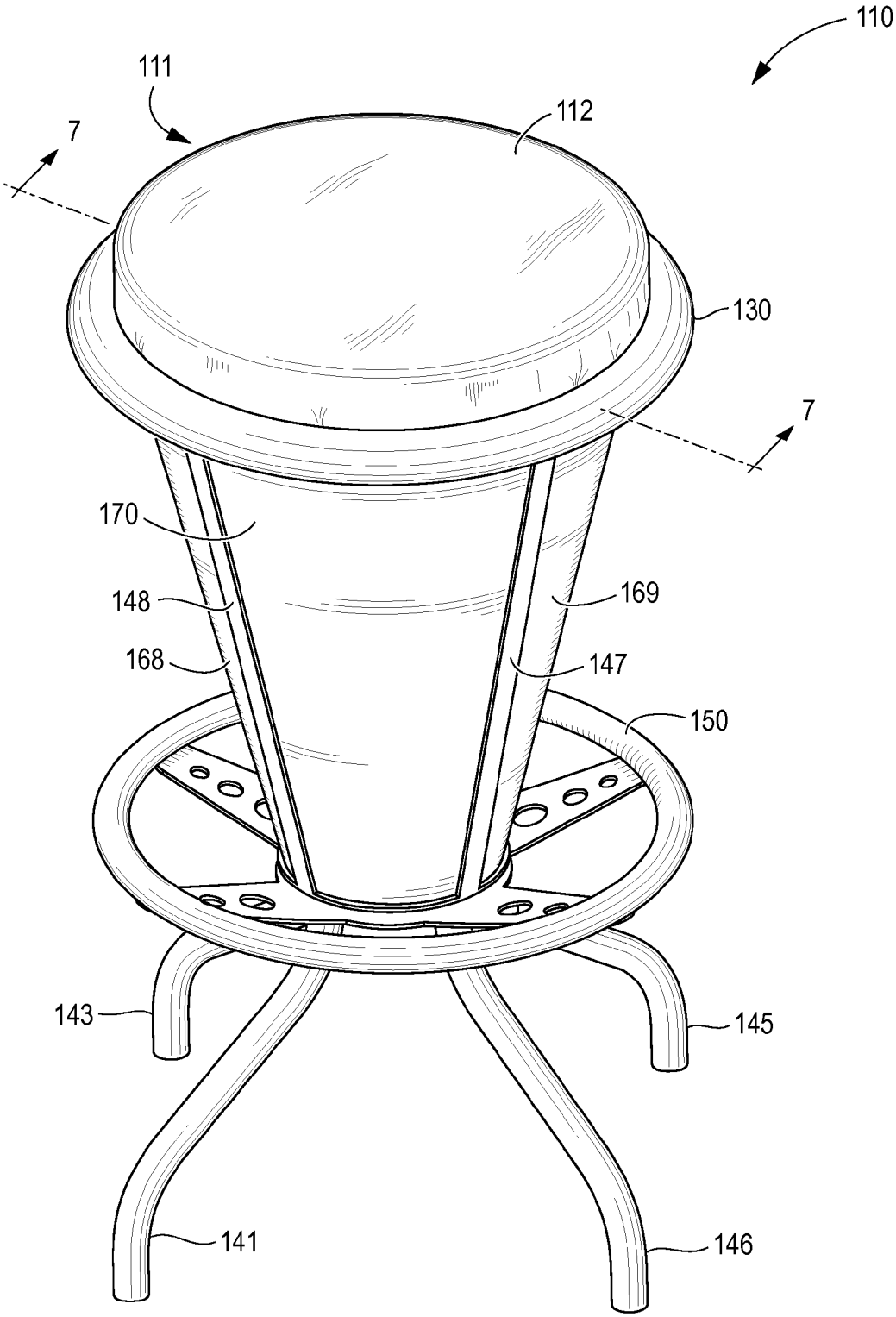
FIG. 6 is a perspective view of a stool having panels that rotate with the seat.
Figure 7:
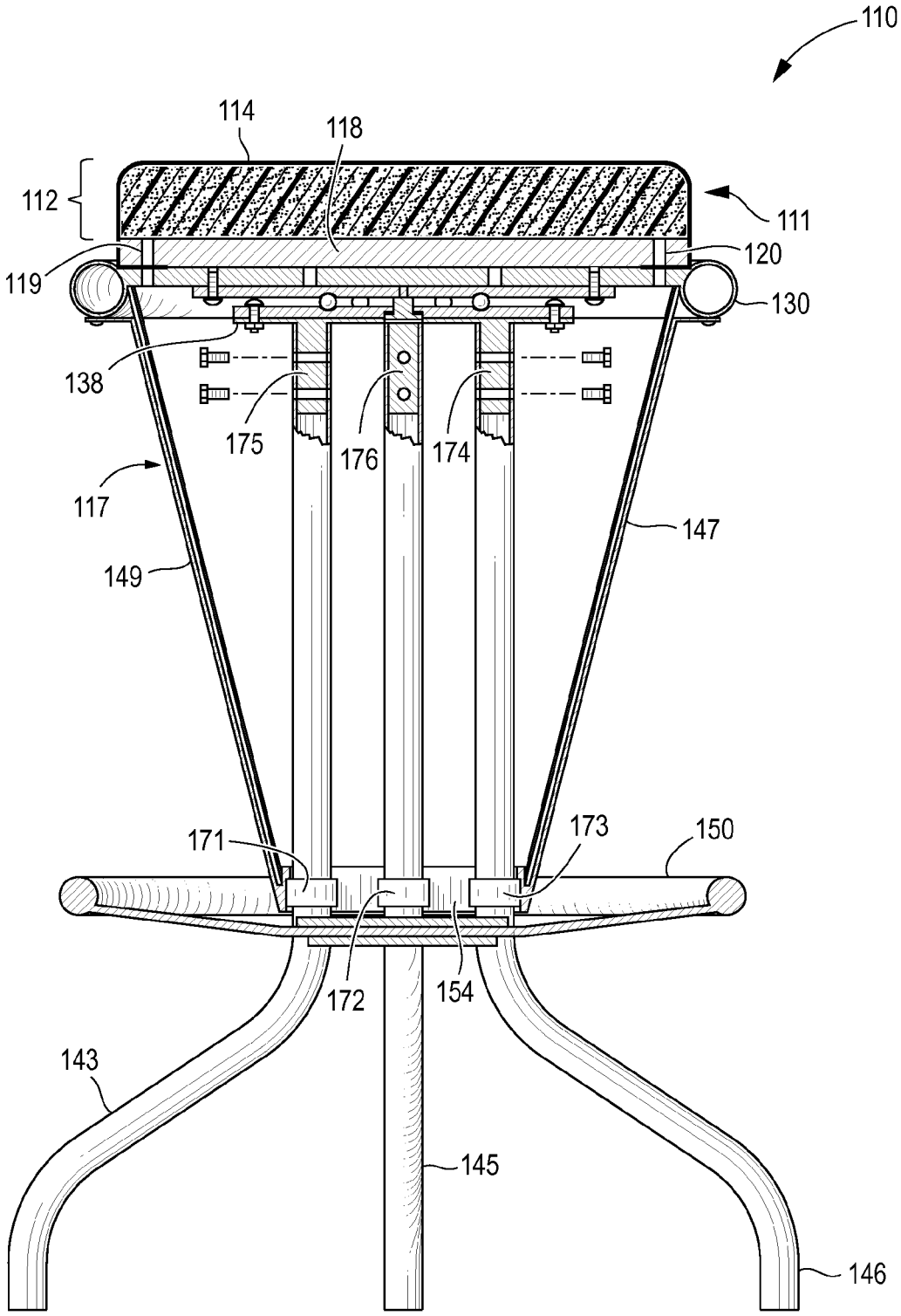
FIG. 7 is a side sectional view of the stool of FIG. 6.

A second embodiment of the present invention is shown in FIGS. 6 and 7 and is referred to generally as stool 110. In this embodiment, elements shared with the first embodiment (stool 110) are represented by reference numerals increased by factors of 100. For example, the seat cushion 12 in FIGS. 1-5 corresponds to a seat cushion 112 in FIGS. 6-7. In the interest of clarity, some features of this embodiment that are shared with the first embodiment are numbered in FIGS. 6-7, but may not be repeated in the specification.

Referring to FIGS. 6-7, the primary functional difference between stool 110 and stool 10 is that the removable panels 168,169,170 of stool 110 rotate with the seat cushion 112 and seat cushion support ring 130, instead of being rotationally fixed (as is the case in stool 10). In this embodiment, the panel retainers 147,148,149 are each welded to the underside of the seat support ring 130. Alternatively, any suitable means of affixing the panel retainers 147,148,149 could be used and the panel retainers 147,148,149 could potentially be affixed to other portions of the portion of the seat that rotates with the seat cushion 112, such as the seat base 118.

The lower end of the each of the panel retainers 147,148,149 is joined at a plate 154. The panel retainers 147,148,149 are joined at a plate 154 define a panel carriage 117. The carriage 117 is free-hanging at its lower end and preferably includes a stabilization structure at its lower end which reduces non-rotational movement of the carriage 117. For example, needle bearings 171,172,173 could be attached to the legs 141,143,145,146 in a vertical position that coincides with the plate 154 and the plate could include a bearing surface (not shown) that would engage the needle bearings 171,172,173.

In this embodiment, the portion of the legs 141,143,145,146 located above the foot rail 150 is shown as being vertical, and is attached to the swivel bottom plate 138 by vertical posts 174,175,176, respectively (the post for leg 145 is not shown). Although, the legs 141,143,145,146 are shown as being attached to the posts with threaded holes and screws, any suitable means of attachment could be used.

Figure 8:
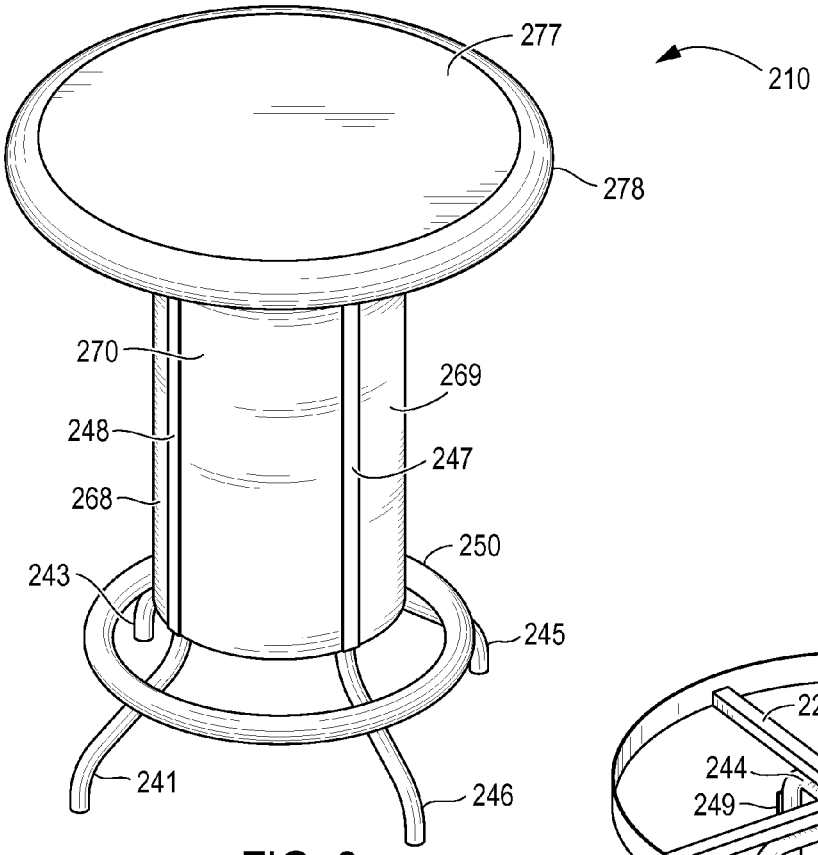
FIG. 8 is a perspective view of a table having removable panels.
Figure 9:
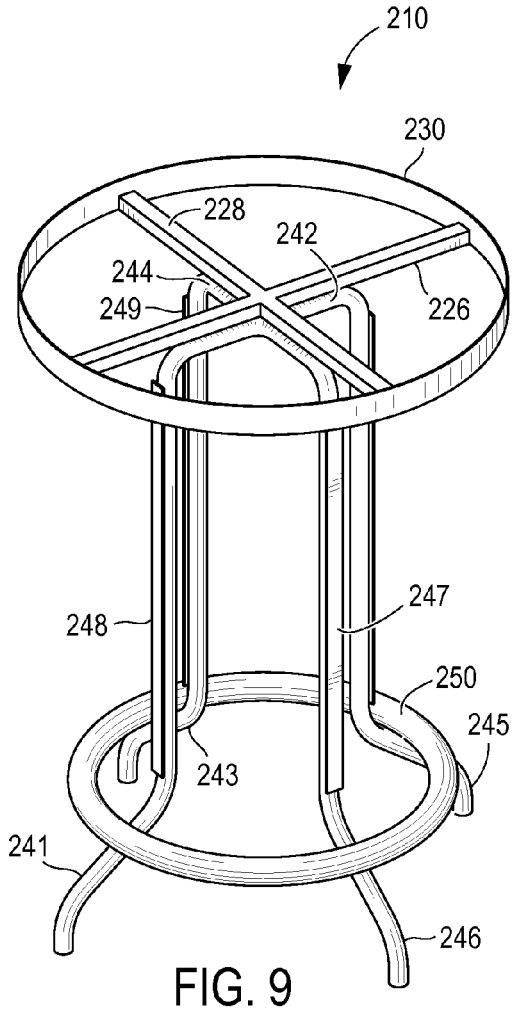
FIG. 9 is a perspective view of the table of FIG. 8, shown with the table top surface and panels removed, in order to show the table substructure.

Another alternative embodiment of the present invention is shown in FIGS. 8-9 and is referred to generally as table 210. In this embodiment, elements shared with the first embodiment (stool 10) are represented by reference numerals increased by factors of 200. For example, the leg 41 in FIGS. 1-5 corresponds to a leg 241 in FIGS. 8-9. In the interest of clarity, some features of this embodiment that are shared with the first embodiment are numbered in FIGS. 8-9, but may not be repeated in the specification.

Like the stool 10, the table 210 includes four evenly-spaced legs 241,243,245,246 which are secured to each other via cross members 242,244. Each leg 241 includes a panel retainer 247 attached thereto, which secures the removable panels 268,269,270 (and a fourth panel that is not visible in FIG. 8) in place between the panel retainers 247,248,249 (and a fourth panel retainer attached to leg 243, which is not visible in FIG. 9).

In this embodiment, the portions of the legs 241,243,245,246 to which the panel retainers 247,248,249 are attached are preferably vertical, so that removable panels 268,269,270 collectively form a generally cylindrical shape when installed on the table 210. Accordingly, each of the panels 268,269,270 is preferably rectangular in shape and can be formed either flat or in a curvature that is slightly less than the curvature when installed. It would, of course, be possible to configure the legs 241,243,245,246 and panel retainers 247,248,249 so that the removable panels 268,269,270 collectively formed a conical shape, as with stool 10 and stool 110.

Instead of a seat, the table 210 includes a fixed table top surface 277. A cylindrically-shaped table top support ring 230 is welded, or otherwise affixed, to the ends of the cross members 242,244. A table top surface 277 is secured to the support ring 230 and may optionally include a rim 278 which is positioned outside the support ring 230 and provides a more rounded edge for the perimeter of the table top. In this embodiment, the table top surface 277 is not designed to be easily removable, which means that the angles of intersection of the cross-members 242,244 can be orthogonal.

The table 210 also preferably includes a foot rail 250. In this embodiment, the foot rail 250 is tubular in cross-section and is preferably affixed to each of the legs 241,243,245,246 a few inches from the bottom of each leg 241,243,245,246. Any suitable means of attachment could be used, including welding, screws, bolts, band clamps, etc.

Figure 11:
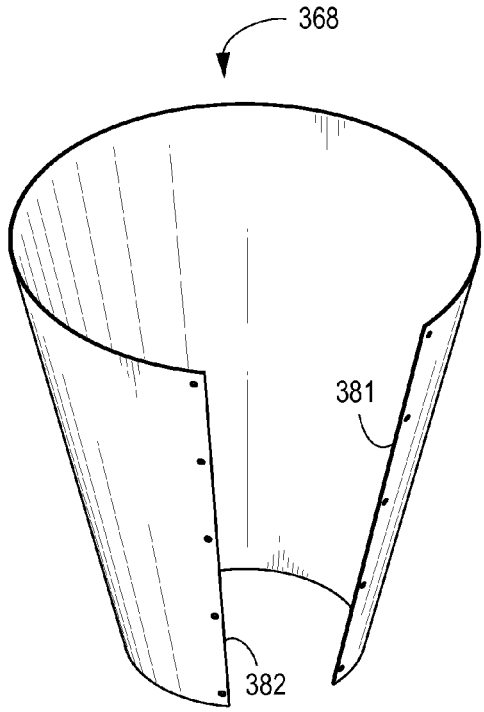
FIG. 11 is a perspective view of the panel shown in FIG. 10.
Figure 10:
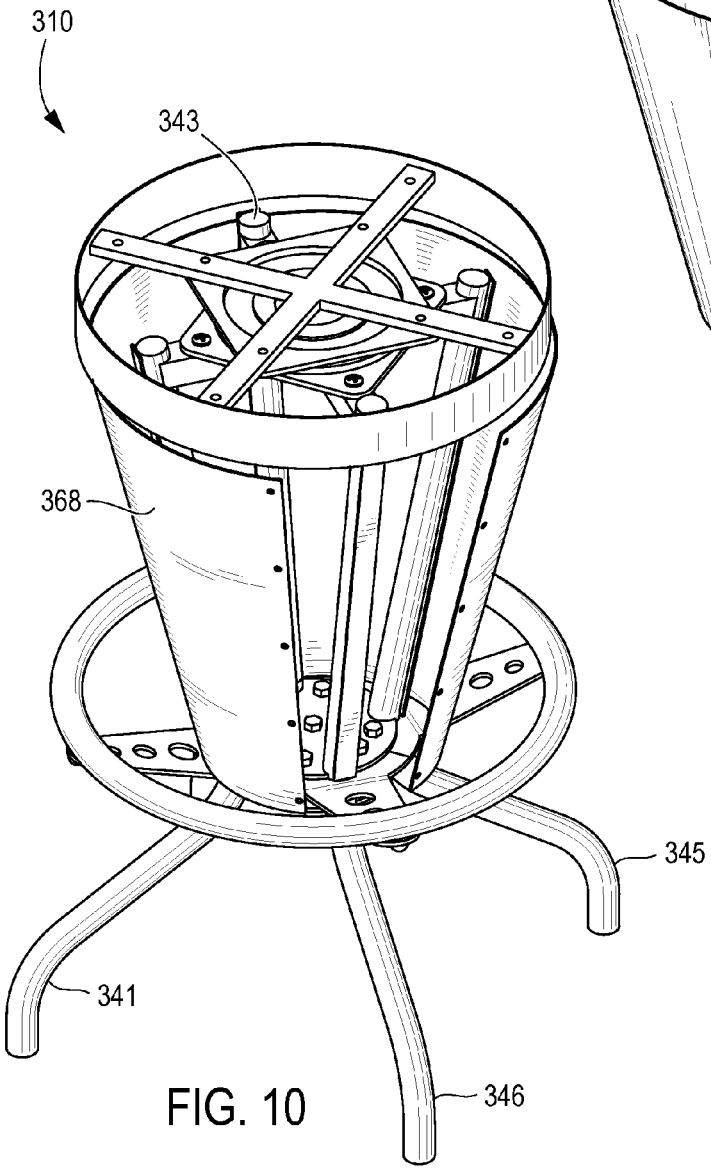
FIG. 10 is a perspective view of the stool of FIG. 2, with a single removable panel, instead of a plurality of panels.

FIGS. 10-11 show a stool 310 having a one-piece removable panel 368 instead of multiple panels, as shown in stools 10 and 110. Other than panel 368, stool 310 is preferably substantially identical to stool 10.

The panel 368 is installed by being wrapped around the upper portions of the legs 341,343,345,346. The panel 368 is preferably secured by affixing one of its vertical ends 381 in an overlapping position with the other vertical end 382. This can be accomplished a number of ways, including using hook-and-loop fasteners, snaps, etc.

The one-piece panel 368 could alternatively be used with any other embodiment of the present invention. For example, a single one-piece panel could be used instead of the four panels 168,169,170 of stool 110 (in which the one-piece panel would rotate with the seat 111). Similarly, a single one-piece cylindrical panel could be used instead of the four panels 268,269,270 used in the table 210.

Figure 12:
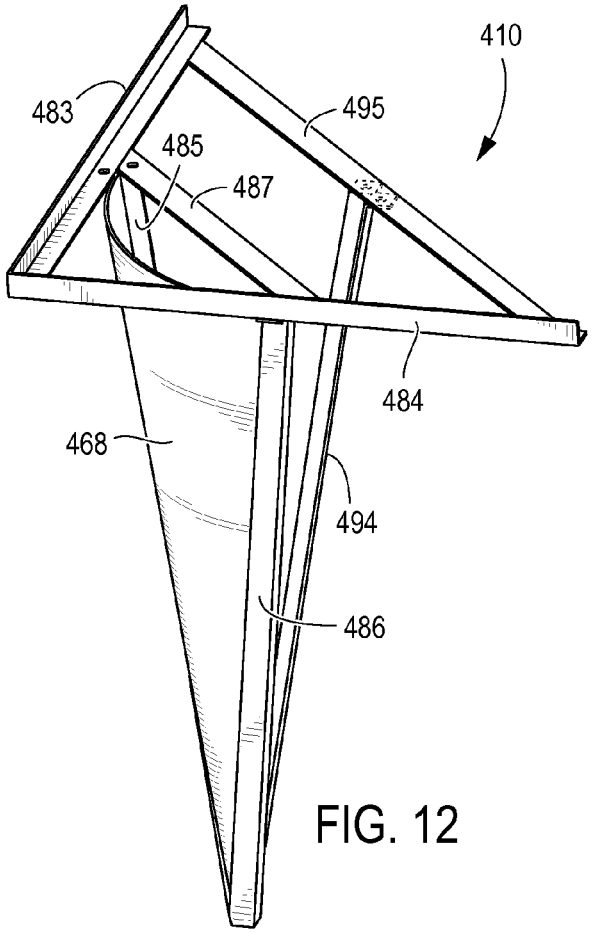
FIG. 12 is a perspective view of a leg.
Figure 13:
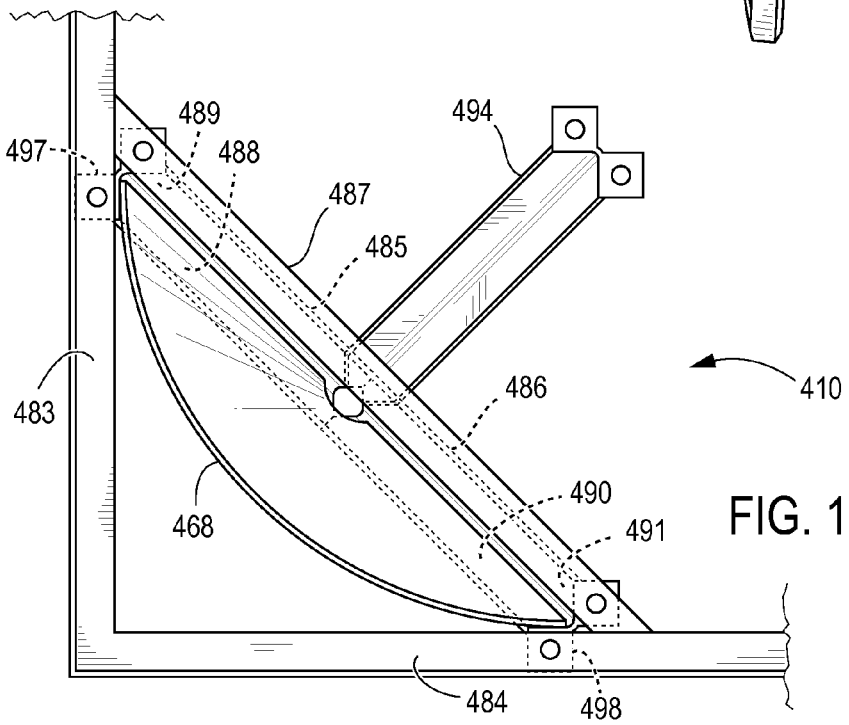
FIG. 13 is a partial top view of the leg of FIG. 12, shown with an optional support leg in dashed lines.
Figure 14:
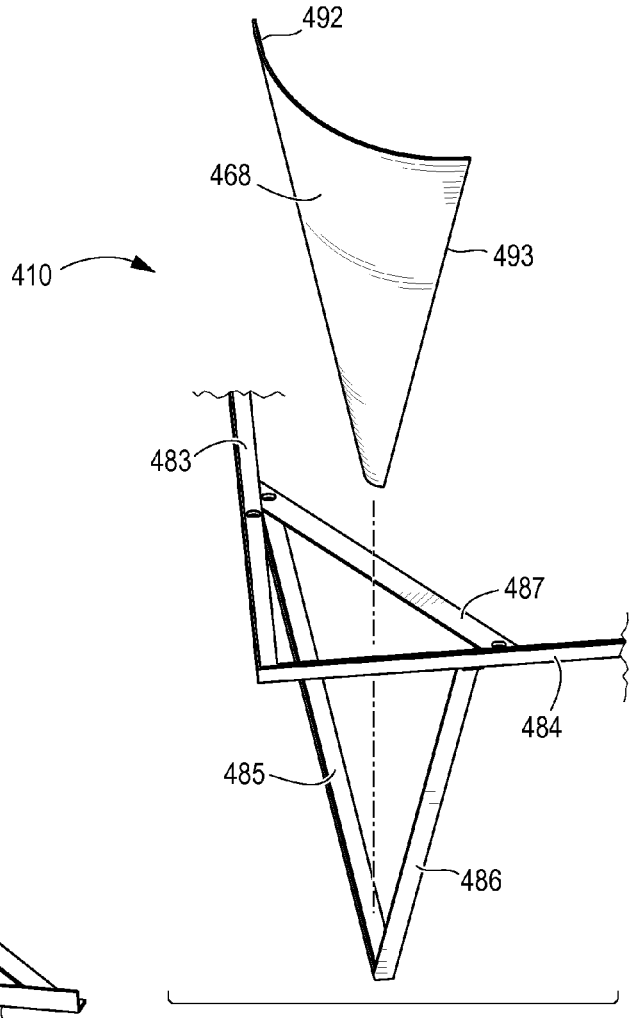
FIG. 14 is a perspective view of the leg of FIG. 12, shown with the removable panel in an un-installed position and without the optional support leg.

Referring now to FIGS. 12-14, another alternative embodiment of the invention is shown, which comprises a leg 410 having a single removable panel 468. The leg 410 could be used as part of any one of several different types of furniture, including tables, chairs, benches, etc. In order to fully support most applicable types of furniture, multiple legs are required.

The leg 410 of the present invention could be used either in combination with other identical legs or in combination with some identical legs and conventional legs (i.e., without removable panels). The leg 410 comprises three primary functional components: the removable panel 468, a panel-retaining structure and a furniture-engaging structure.

The panel 468 is preferably conical in shape and is very similar in structure to the panels 68,168 of stools 10 and 110. As with the panels used with stools 10 and 110, panel 468 could be manufactured to be planar when no external forces are applied thereto or, alternatively, could be manufactured to retain a bowed shape when no external forces are applied thereto.

In order to show how the leg 410 engages a piece of furniture, a portion of a table-top frame, comprising two right-angle brackets 483,484, is shown in FIGS. 12-15. In an application in which the leg 410 is used as part of a table, the right-angle brackets 483,484 would be part of the frame that supports the table top (not shown). In an application in which the leg 410 is used as part of a chair, the right-angle brackets 483,484 would be part of the frame that supports the chair seat (not shown).

The panel-retaining structure preferably comprises two panel retainers 485,486, which form a "V" shape, are affixed to each other at the lower end. Each of the panel retainers 485,486 has a support member 497,498 (see FIG. 13), located at its upper end that attaches the retainers 485,486 to the brackets 483,484. Each panel retainer 485,486 preferably includes a bearing surface 488,490 which prevents the panel 468 from flexing outwardly beyond the panel retainer 485, 486. Each panel retainer 485,486 also preferably includes an abutment 489,491, which provides a "stop" for the vertical edges 491,493 of the panel 468 when inserted into the retainer 485,486. In this embodiment, the bearing surface 488 of the retainer 485 is oriented parallel to the bracket 483 and oriented 90 degrees relative to the bearing surface 490 of the other retainer 486, which is oriented parallel to the other bracket 484.

Although its precise dimensions and/or proportions may differ, the panel 468 of the leg 410 is otherwise structurally identical to the panels 68,69,70 of the stool 10.

The panel-retaining structure also preferably includes a cross-member 487 which provides additional rigidity to both the panel retainers 485,486 and the brackets 483,484. In this embodiment, the cross-member 487 is a right-angle member that spans from the top of one panel retainer 485 to the other panel retainer 486.

In order to provide additional rigidity for the panel retainers 485,486 when the leg 410 is incorporated into heavy and/or large furniture items, an optional support leg 494 may be provided. In this embodiment, the support leg 494 is affixed to the bottom ends of the panel retainers 485,486. The upper end of the support leg 494 is affixed to a cross-member 495, which spans from one bracket 483 to the other bracket 484.

All of the structural members of the leg 410, including the panel retainers 485,486, cross-members 487,495 and the support leg 494, are preferably made from steel angle irons.

Figure 15:
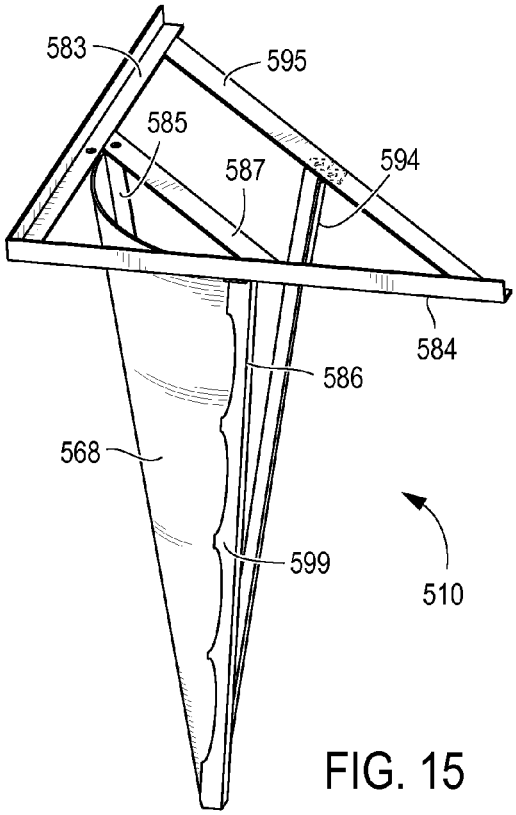
FIG. 15 is a perspective view of a leg having a decorative edge on the panel retainers.

Another alternative embodiment of the leg 410 is shown in FIG. 15 and is referred to generally as leg 5 10. In this embodiment, elements shared with leg 410 are represented by reference numerals increased by factors of 100. For example, the bracket 483 in FIGS. 12-14 corresponds to a bracket 583 in FIG. 15. In the interest of clarity, some features of this embodiment that are shared with leg 410 are numbered in FIG. 15, but are not repeated in the specification.

In this embodiment, the panel retainers 585,586 include a decorative edge 599. The decorative edge 599 shown in FIG. 15 is intended to be merely exemplary. Of course, many other shapes and contours could be provided.

Any of the embodiments of the present invention described herein could optionally include means for illuminating the removable panels from within (not shown). Such means could comprise a light source located behind the panel(s), such as an incandescent light bulb, for example. Illuminating the panel (s) would draw additional attention to any advertising and/or promotional material displayed on the panel(s).

While the principles of the invention have been described above in connection with preferred embodiments, it is to be clearly understood that this description is made only by way of example and not as a limitation of the scope of the invention.

The invention claimed is:

1. A furniture item comprising:

a seat;

a seat support structure that supports the seat;

a frame that supports the seat support structure and extends from the seat support structure to a surface upon which a stool rests;

at least one panel located between the seat support structure and the surface, the at least one panel being removably attached to the frame and including a front surface that is convex from a first side edge to a second side edge when the at least one panel is installed on the frame, the at least one panel being adapted to be removed from the frame by removing the seat and sliding the at least one panel through the seat support structure.

2. The furniture item of claim 1, wherein each of the at least one panel comprises a front surface that faces outwardly from the frame and is externally visible when the at least one panel is installed on the frame, the front surface of each of the at least one panel aggregately defining a display surface.

3. The furniture item of claim 2, wherein the display surface is generally conical in shape.

4. The furniture item of claim 2, wherein the display surface is generally cylindrical in shape.

5. The furniture item of claim 2, wherein the display surface is tapered.

6. The furniture item of claim 1, wherein the front surface is planar when the at least one panel is removed from the frame and under no external loading.

7. The furniture item of claim 1, wherein the-frame comprises a plurality of panel retainers and the first and second side edges are each retained by one of the plurality of panel retainers when the at least one panel is installed on the frame.

8. The furniture item of claim 7, wherein the frame further comprises a plurality of legs, each of the plurality of legs comprising an upright portion to which one of the plurality of panel retainers is attached.

9. The furniture item of claim 8, wherein each of the plurality of panel retainers comprises linear strips which are externally visible when the at least one panel is installed on the frame.

10. The furniture item of claim 8, wherein each of the first and second edges of the at least one panel is retained between one of the plurality of legs and the one of the plurality of panel retainers.

11. The furniture item of claim 1, wherein the at least one panel can be removed from the frame by flexing the first side edge toward the second side edge.

12. The furniture item of claim 1, wherein the seat support structure comprises a first cross-member that intersects a second cross-member at a non-orthogonal angle.

13. The furniture item of claim 12, wherein the first and second cross-members intersect to form an angle of at least 95 degrees.

14. The furniture item of claim 1, wherein the at least one panel comprises a single panel that encircles the frame.

15. A stool comprising:

an upper portion comprising a seat;

a frame located below the upper portion and being comprised of a plurality of spaced-apart tubular elements, the frame providing vertical support for at least one panel, the at least one panel being removably installable on the frame and having a front surface that is externally visible when the at least one panel is installed on the frame, the at least one panel comprising first and second side edges;

wherein the front surface of the at least one panel is convex from the first side edge to the second side edge when the at least one panel is installed on the frame, and wherein the at least one panel can be removed from the frame by flexing the first side edge toward the second side edge; and wherein each of the plurality of spaced-apart tubular elements comprises a panel retainer located in an upright portion, and a leg portion, wherein the panel retainer is adapted to retain one of the first and second side edges when the at least one panel is installed on the frame.

16. The stool of claim 15, wherein the seat is rotatable relative to the frame.

17. The stool of claim 15, further comprising a light source located interior to the frame.

* * * * *